US009011260B2

(12) United States Patent
Chen

(10) Patent No.: US 9,011,260 B2
(45) Date of Patent: Apr. 21, 2015

(54) DEVICE AND METHOD FOR AUTOMATIC SWING CONTROL

(76) Inventor: Cheng-Ming Chen, Taichung (TW)

( * ) Notice: Subject to any disclaimer, the term of this patent is extended or adjusted under 35 U.S.C. 154(b) by 15 days.

(21) Appl. No.: 14/115,249

(22) PCT Filed: May 3, 2011

(86) PCT No.: PCT/CN2011/000772
§ 371 (c)(1),
(2), (4) Date: Nov. 1, 2013

(87) PCT Pub. No.: WO2012/149662
PCT Pub. Date: Nov. 8, 2012

(65) Prior Publication Data

US 2014/0073443 A1 Mar. 13, 2014

(51) Int. Cl.
*A63G 9/16* (2006.01)
*A63G 9/00* (2006.01)

(52) U.S. Cl.
CPC ..... *A63G 9/16* (2013.01)

(58) Field of Classification Search
USPC ..... 472/118, 119, 120, 121, 122, 123, 124, 472/125; 318/443, 444
See application file for complete search history.

(56) References Cited

U.S. PATENT DOCUMENTS

| | | | | |
|---|---|---|---|---|
| 3,794,317 | A | 2/1974 | Barrett | |
| 5,562,548 | A | 10/1996 | Pinch et al. | |
| 6,024,648 | A | 2/2000 | Shurtleff et al. | |
| 6,339,304 | B1 * | 1/2002 | Allison et al. | 318/443 |

FOREIGN PATENT DOCUMENTS

| | | | |
|---|---|---|---|
| CN | 201015506 | Y | 2/2008 |
| CN | 101352614 | A | 1/2009 |
| CN | 101716035 | A | 6/2010 |

* cited by examiner

*Primary Examiner* — Kien Nguyen
(74) *Attorney, Agent, or Firm* — Muncy, Geissler, Olds & Lowe, P.C.

(57) ABSTRACT

A device and a method for automatic swing control are disclosed. The device and method are used for the automatic swing control of an overhang. The device for automatic swing control comprises an actuator and a movable block. The movable block comprises a hanger and an angle sensing device. The hanger is pivotably mounted on the lower end of the movable block and is used to suspend the overhang. The angle sensing device is electrically connected to the actuator, and used to sense the movement parameters of the hanger, and starts the selective rotation of the actuator when the swing angle is less than a preset value, so that when the hanger is at its predicted highest swing position, the movable block moves toward the direction where the hanger is about to move after the hanger passes its actual highest swing position to drag the overhang to swing.

10 Claims, 8 Drawing Sheets

DEVICE AND METHOD FOR AUTOMATIC SWING CONTROL

BACKGROUND OF THE INVENTION

1. Field of the Invention

The present invention generally relates to a device for automatic swing control, particularly, to a device and a method thereof using a driver to automatically control swing of an overhang.

2. Description of the Related

The hectic stressful pace of life becomes an unavoidable source of stress for modern people, so most people are finding a simple and comfortable relaxation way which does not affect the life. Taking a swinging hanging chair or hammock is a common leisure and relaxation way. When taking the hanging chairs or hammocks, user's body will swing slowly with the hanging chairs or hammocks, so that user can ignore vexation and calm the mind in the regular swing.

It is comfortable to ride the hanging chair or hammock, however, the drawback is that the hanging chair or hammock must be driven by external forces for continuous swing. Swing angle of the hanging chair or hammock will gradually become smaller and thus stationary due to the effect of inertia and gravity, and then it must be re-applied force to swing again. For persons who want to spend time pleasingly on the hanging chair or hammock, it is disturbing and inconvenient that the hanging chair or hammock must be repeated to push for swing.

Chinese utility model patent No. 201015506 discloses an electric swinging device. The electric swinging device is provided with a driving part, and the driving part is connected with a control circuit, and an output end of the driving part is mutually engaged with a reduction gear unit. One gear of the gear unit is connected and provided with an outward extending rotation axis, which is matched with a variable resistor capable of synchronously changing impedance while rotating. The variable resistor is connected with the control circuit. The rotation axis is connected with a swing part. Therefore, when the driving part is activated, the utility model moves at a reduced speed through the reduction gear unit and swings in certain angle through the swing part driven by the rotation axis. In the meantime, the variable resistor changes impedance following rotation of the rotation axis and input the impedance into the control circuit. Swing period and phase may be known through process of the control circuit, thus driving force of the driving part may be increased or reduced by means of PWM (Pulse Width Modulation). In such a way, swing angle can be controlled and power can be saved.

However, technology disclosed by this utility model patent uses the driver to drive swing part to swing at a preset swing angle by the electric driving means, but its swinging end that is the rotating shaft is fixed, and while the swing part is driven to swing, vibration and lagging sense will be generated and not comfortable for the rider. Besides, strenuous rotation of the motor easily causes damage of parts.

In order to obtain more comfortable riding experience, fewer parts and power consumption saving, it is necessary to develop a device for automatic swing control capable of gently driving, reducing vibration sense and maintaining the usage durability of device, so that the purposes of improving ride quality and providing better and more comfortable ride experience for further reducing stress and relaxation can be achieved.

SUMMARY OF THE INVENTION

Therefore, it is a primary objective of the present invention to provide a device for automatic swing control to solve the shortcoming that conventional hanging chair or hammock is lack of convenience, or cannot drive swing smoothly.

To achieve the foregoing objective, the present invention provides a device for automatic swing control which is applied for automatic control of the swing of an overhang, and the device for automatic swing control comprises an actuator and a movable block. The actuator has selective normal rotation or counter rotation, and the movable block is located on a side of the actuator, and driven to reciprocate by the normal rotation or counter rotation of the actuator. The movable block comprises a hanger and an angle sensing device. The hanger is pivotably mounted on a lower end of the movable block and used to suspend the overhang. The angle sensing device is electrically connected to the actuator and used to sense a swing angle, a swing direction, and a predicted highest swing position of the hanger, and the angle sensing device starts the selective normal rotation or counter rotation of the actuator when the swing angle is less than a preset value, so that when the hanger is at the predicted highest swing position, the movable block moves toward the direction in which the hanger is about to move after the hanger passes an actual highest swing position to drag the overhang to swing. The predicted highest swing position is lower than or equal to the actual highest swing position.

Preferably, a pivot is located on one end of the hanger and corresponds to the angle sensing device, and the hanger swings around the pivot.

Preferably, the device for automatic swing control further comprises a processing unit electrically connected to the actuator and the angle sensing device. The processing unit receives the swing angle, the swing direction, and the predict highest swing position sensed by the angle sensing device, and compares the swing angle with the preset value, and the processing unit generates a start instruction to drive normal rotation or counter rotation of the actuator according to the swing direction and the predicted highest swing position when the swing angle is less than the preset value, so that when the hanger is at the predicted highest swing position, the movable block moves toward to the same direction in which the hanger is about to move after the hanger passes the actual highest swing position, to drag the overhang to swing.

Preferably, the device for automatic swing control further comprises at least one position sensing device connected to the processing unit, wherein the position sensing device senses the position of the movable block and the processing unit generates a stop instruction to stop rotation of the actuator when the movable block moves to a preset position.

Preferably, the device for automatic swing control further comprises a screw arranged horizontally, wherein the actuator is connected to an end of the screw, and the movable block is mounted on the screw, a screw hole is located on the upper end of the movable block, the screw penetrates the screw hole and fits to the screw hole, so that the actuator drives the screw to rotate and the movable block reciprocate along the screw.

To achieve the foregoing objective, the present invention further provides a method for automatic swing control which is applied to use a device for automatic swing control for automatic control of the swing of an overhang, the device for automatic swing control comprises an actuator and a movable block, the movable block comprising a hanger and an angle sensing device, the method for automatic swing control comprising following steps of: using the angle sensing device to sense a swing angle, a swing direction and a predicted highest swing position of the hanger; starting the selective normal rotation or counter rotation of the actuator when the swing angle is less than a preset value; and according to the normal rotation or counter rotation of the actuator, when the hanger is at the predicted highest swing position, moving the movable block toward to the same direction in which the hanger is about to move after the hanger passes the actual highest swing position, to drag the overhang to swing; wherein, the predicted highest swing position is less than or equal to the actual highest swing position.

Preferably, the device for automatic swing control further comprises a processing unit, and a pivot is located on one end of the hanger, and the method for automatic swing control further comprises the following steps of: swinging the hanger around the pivot; using the processing unit to compare the swing angle and the preset value sensed by the angle sensing device; using the processing unit to generate a start instruction to drive rotation of the actuator when the swing angle is less than the preset value; and according to the rotation of the actuator, when the hanger is at the predicted highest swing position, moving the movable block toward to the same direction in which the hanger is about to move after the hanger passes the actual highest swing position.

Preferably, the device for automatic swing control further comprises a position sensing device, and the method for automatic swing control further comprises the following steps of: using the position sensing device to sense the position of the movable block; and using the processing unit to generate a stop instruction to stop the rotation of the actuator when the movable block moves to a preset position.

Preferably, the start instruction comprises a normal rotation instruction or a counter rotation instruction. The actuator rotates clockwise according to the normal rotation instruction or rotates counterclockwise according to the counter rotation instruction, to drive the movable block to reciprocate.

Preferably, the device for automatic swing control further comprises a screw, and the actuator rotates clockwise according to the normal rotation instruction or rotates counterclockwise according to the counter rotation instruction, to drive the screw to rotate in the clockwise or counterclockwise direction, so that the movable block reciprocates along the screw.

In summary, the device for automatic swing control and method thereof according to the present invention may have one or more of the following advantages:

(1) In the device for automatic swing control and method thereof, the hanger is driven to swing by the actuator, so as to drive the overhang located on the hanger to swing. The overhang maybe a hammock, a hanging chair, a swing or, a cradle. Therefore, the actuator is used for automatic swing control, and solve the inconvenience that a user must push to keep swinging of such an equipment when riding on it.

(2) The device for automatic swing control and method thereof apply a resonance principle, while the movable block is driven to slip around, an angle sensing device senses a swing angle of the hanger, so that the moving direction of the movable block can be the same as the swing direction of the hanger, and the greatest swing effect can be achieved by the least force, and the consumption of motor and power can be reduced.

(3) The device for automatic swing control and method discards the conventional swing way of fixing one end and swinging the other end openly, but use the movable block to reciprocate along the screw on one end and correspond to the swing angle of the hanger for resonance, so as to drag the overhang to swing. Therefore, the swing of the overhang is smooth, and the rider will not feel shaking or lagging but have comfortable and gentle riding experience.

BRIEF DESCRIPTION OF THE DRAWINGS

The detailed structure, operating principle, and effects of the present invention will now be described in more details hereinafter with reference to the accompanying drawings that show various embodiments of the invention as follows.

DETAILED DESCRIPTION OF THE PREFERRED EMBODIMENTS

Figure 1:
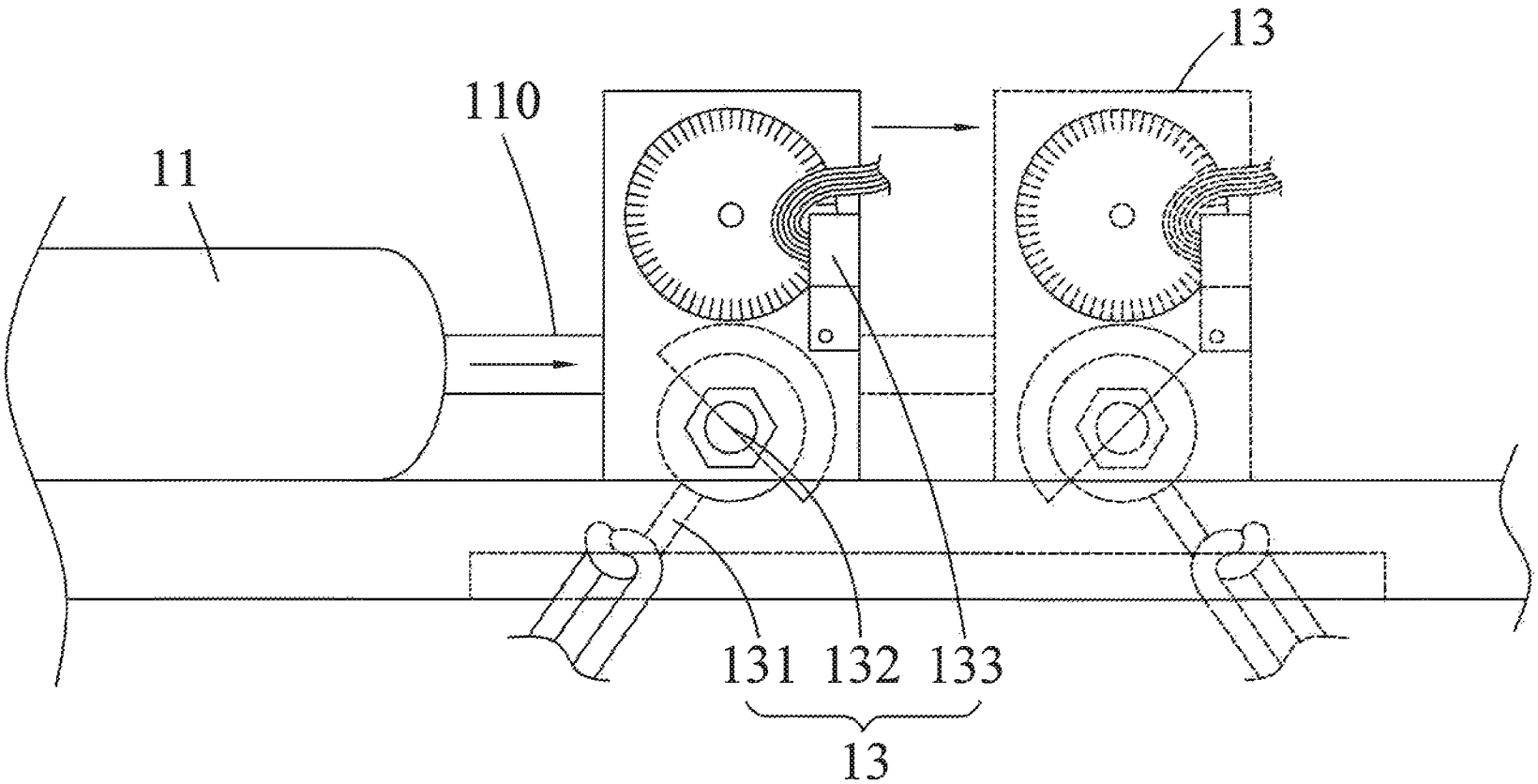
FIG. 1 is a schematic view of the first embodiment of the device for automatic swing control according to the present invention.

The present invention will be described more fully with reference to the accompanying drawings, in which exemplary embodiments of the invention are shown. As those skilled in the art would realize, the described embodiments may be modified in various different ways, all without departing from the spirit or scope of the present invention.

The drawings are schematic and not proportionally scaled down. Relative scales and ratios in the drawings are enlarged or reduced for the purpose of accuracy and/or convenience, and the scales are random and not limited thereto.

It will be understood that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

Figure 2:
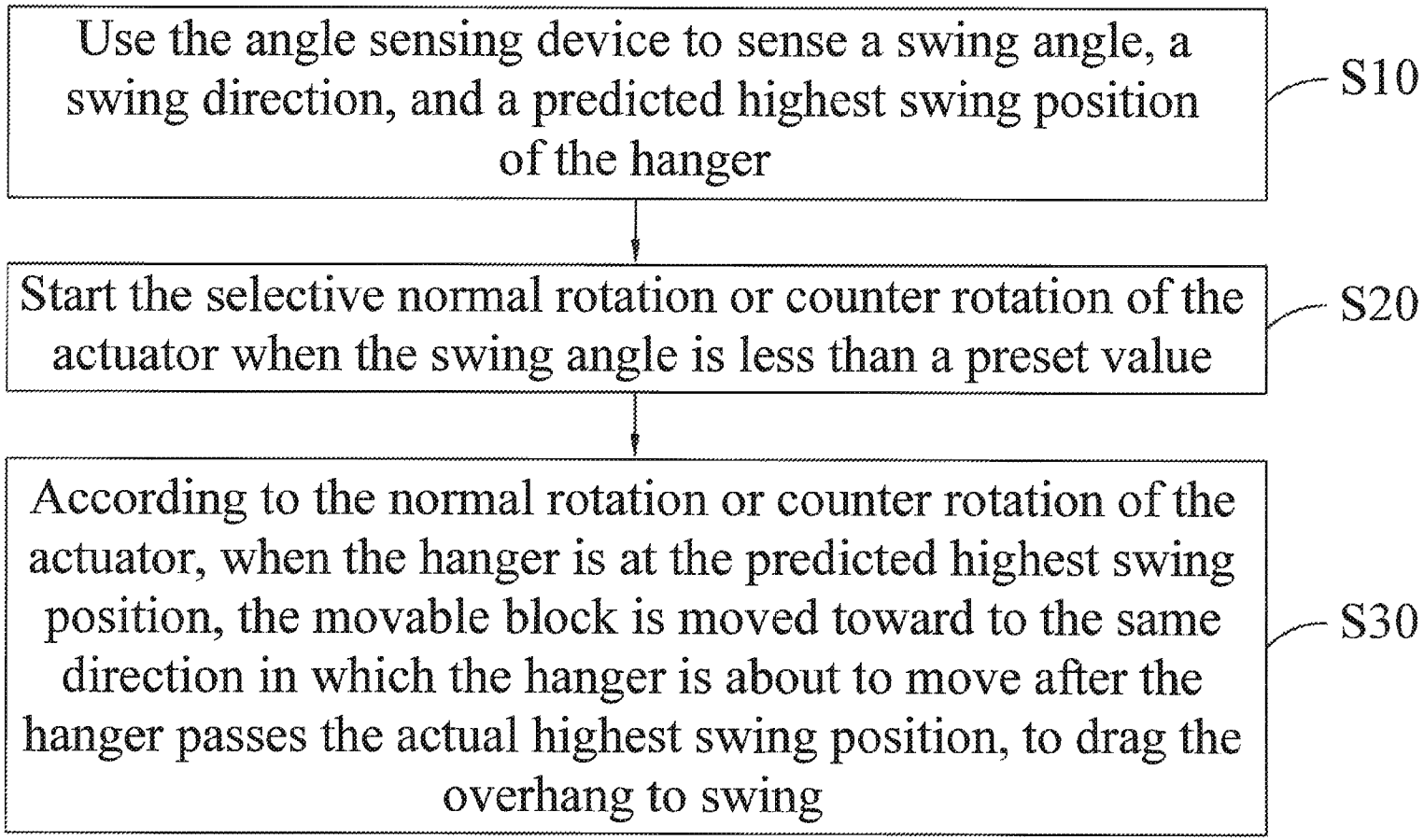
FIG. 2 is a flow chart of the first embodiment of the device for automatic swing control according to the present invention.

Please refer to FIG. 1 and FIG. 2 which illustrate schematic view and flow chart of first embodiment of the device for automatic swing control according to the present invention respectively, the device for automatic swing control comprises an actuator 11 and a movable block 13, and the actuator 11 is connected to an oil pressure rod 110, and rod 110 is connected to the movable block 13. The movable block 13 further comprises a hanger 131, a pivot 132 and an angle sensing device 133, the actuator 11, the angle sensing device 133 and an external processing unit (not shown in FIG. 1 and FIG. 2) are electrically connected, and an external overhang (not shown in FIG. 1 and FIG. 2) is hanged on the hanger 131.

The purpose of automatic swing control can be achieved by the steps shown in FIG. 2 and the configuration shown in FIG. 1. The steps shown in FIG. 2 comprise: (S10) the angle sensing device is used to sense a swing angle, a swing direction, and a predicted highest swing position of the hanger; (S20) when the swing angle is less than preset value, the selective normal rotation or counter rotation of the actuator is started; (S30) according to the normal rotation or counter rotation of the actuator, when the hanger is at the predicted highest swing position, the movable block is moved toward to the same direction in which the hanger is about to move after the hanger passes the actual highest swing position, to drag the overhang to swing.

In this embodiment, extension or retraction of the rod 110 is driven by normal rotation or counter rotation of the actuator 11, so that the movable block 13 reciprocates and drives the hanger 131 to drag the overhang to swing. The rod 110 is represented as an oil pressure rod, but is not limited thereto, the rod 110 may be an air pressure rod, or other rod which can be driven to extent or retract by the actuator 11.

Figure 3:
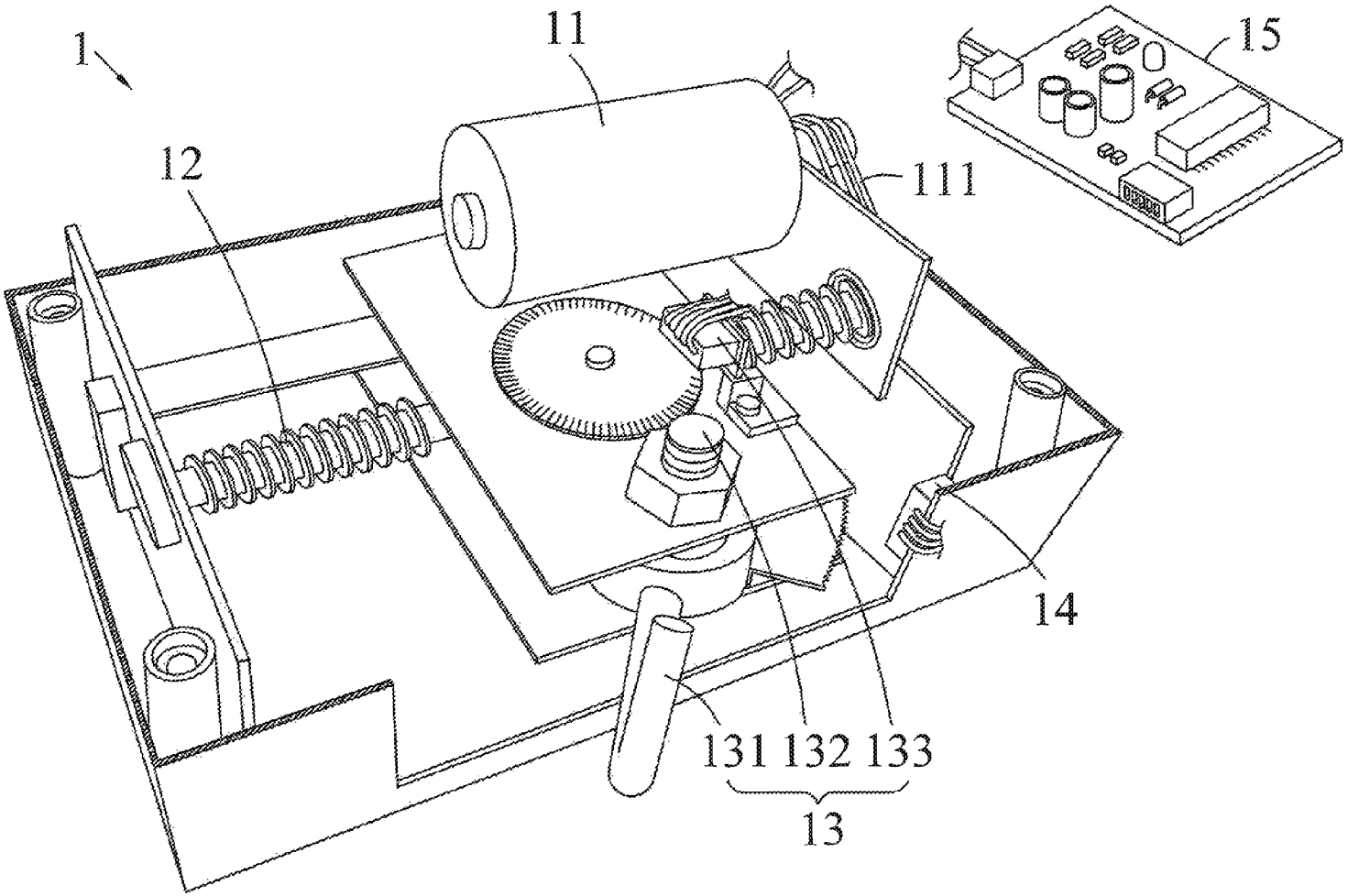
FIG. 3 is a schematic view of the second embodiment of the device for automatic swing control according to the present invention.
Figure 4:
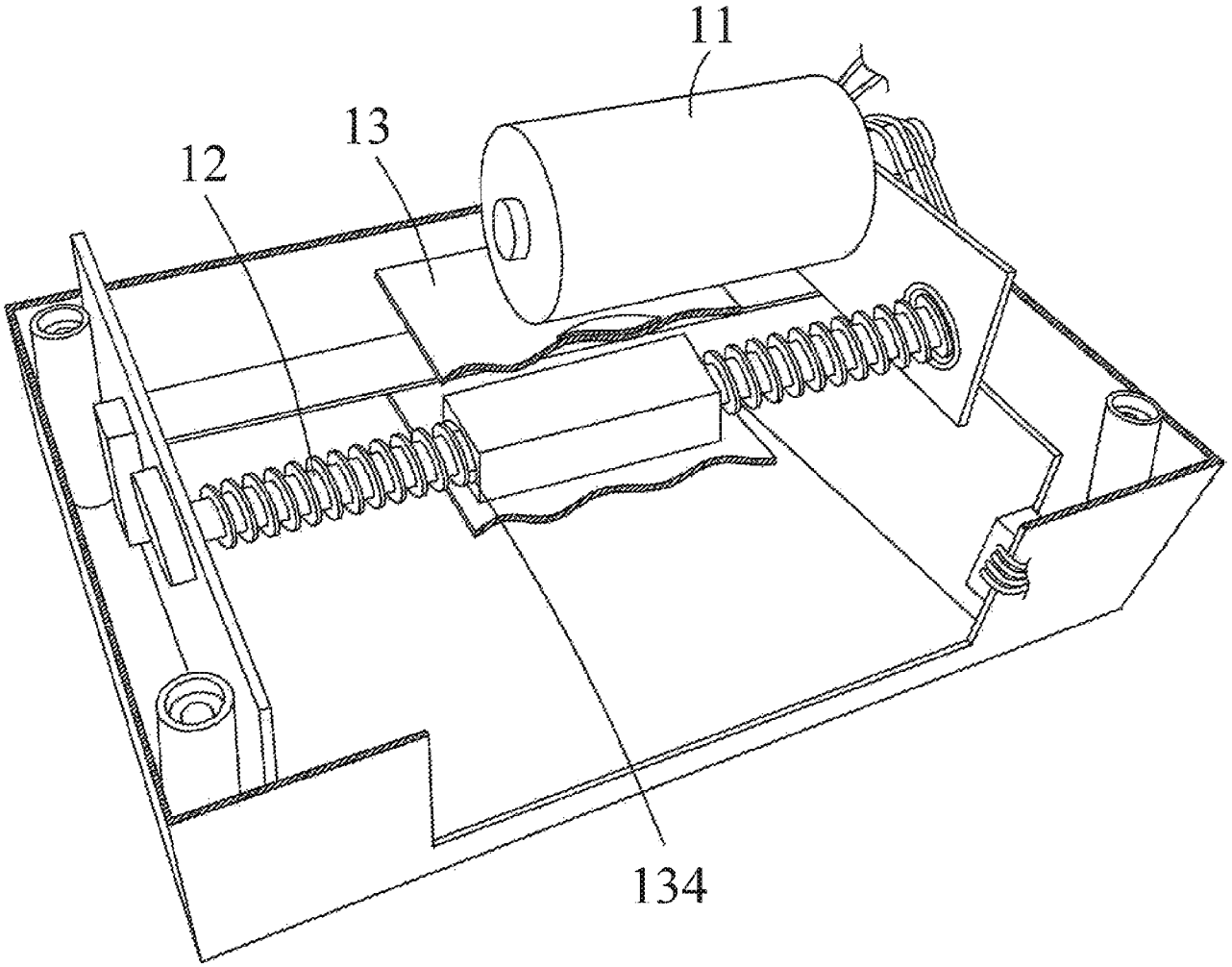
FIG. 4 is a cross sectional view of part of the movable block of the second embodiment according to the present invention.

Please refer to both FIG. 3 and FIG. 4, which illustrate schematic view of the second embodiment of the device for automatic swing control and partial cross sectional view of the movable block of the second embodiment according to the present invention. In FIG. 3 and FIG. 4, the device for automatic swing control 1 comprises the actuator 11, a screw 12, the movable block 13, a position sensing device 14 and a processing unit 15. The movable block 13 further comprises the hanger 131, the pivot 132 and the angle sensing device 133. The actuator 11, the angle sensing device 133 and the position sensing device 14 are electrically connected to the processing unit 15, respectively. The hanger 131 is pivotably mounted on lower end of the movable block 13 by the pivot 132, so that the hanger 131 may swing around the pivot 132. In the upper end of the movable block 13, a screw hole 134 is located correspondingly to the screw 12, so that the screw 12 may movably penetrate the screw hole 134. When screw 12 is driven to normal rotate or counter rotate, the movable block 13 reciprocates along the screw 12.

Figure 5:
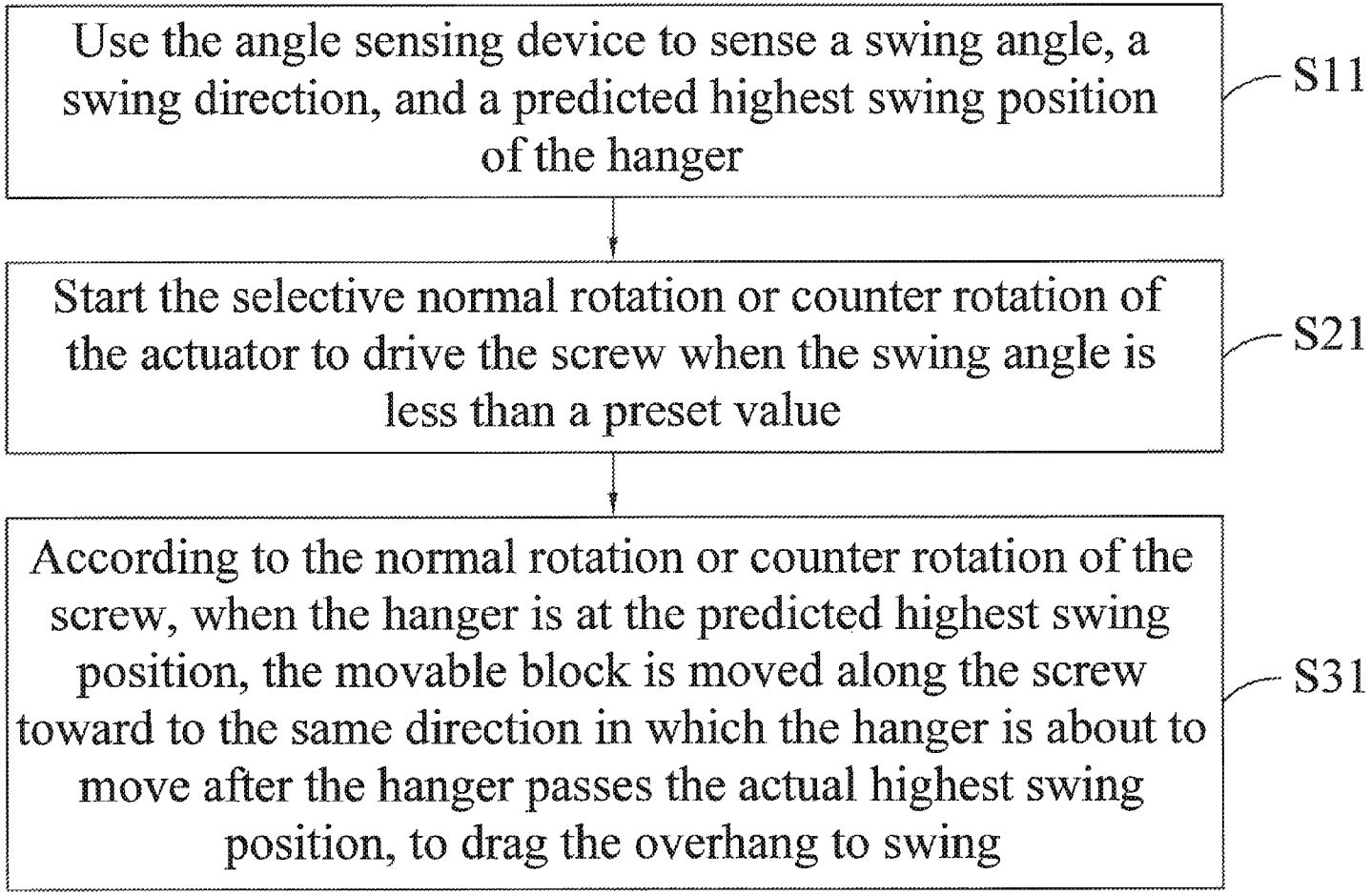
FIG. 5 is a flow chart of the second embodiment of the method for automatic swing control according to the present invention.

Please refer to FIG. 3 to FIG. 5. FIG. 5 is a flow chart of the second embodiment of the method for automatic swing control according to the present invention. The purpose of automatic swing control can be achieved by the steps shown in FIG. 5 and the configuration of device for automatic swing control 1 shown in FIG. 3 and FIG. 4. The steps shown in FIG. 5 comprise: step (S11), the angle sensing device is used to sense the swing angle, the swing direction and the predict d highest swing position of the hanger; step (S21) when the swing angle is less than the preset value, the selective normal rotation or counter rotation of the actuator is started to drive the normal rotation or counter rotation of the screw; and step (S31) according to the normal rotation or counter rotation of the screw, when the hanger is at the predicted highest swing position, the movable block is moved along the screw toward to the same direction in which the hanger is about to move after the hanger passes the actual highest swing position, to drag the overhang to swing.

The screw 12 of the device for automatic swing control 1 is arranged horizontally, and the actuator 11 is provided with a drive belt 111 to drive the screw 12 to rotate, the pivot 132 and the angle sensing device 133 are located correspondingly, so that the angle sensing device 133 can sense the swing angle of the hanger 131, and then generates and transmits a swing angle signal and swing direction signal to the processing unit 15.

The processing unit 15, the actuator 11, and the angle sensing device 133 are electrically connected, and the processing unit 15 is set a parameter of the preset value. The processing unit 15 receives the swing angle signal and swing direction signal, and then compares the swing angle with the preset value. When a comparison result is that the swing angle of the hanger 131 is less than the preset value, the processing unit 15 generates a start instruction to drive the actuator 11 to rotate the screw 12, so that the movable block 13 is moved along the screw 12 toward to the same direction in which the hanger 131 is about to move after the hanger 131 passes the predicted highest swing position and the actual highest swing position. The preset value is determined depending upon the demand, and the hanger 13 can generates different swing amplitudes by setting different preset values. Because it is not easy to predict the actual highest swing position, a predicted highest swing position is set and less than or equal to the actual highest swing position.

The position sensing device 14 and processing unit 15 are electrically connected, the position sensing device 14 is used to sense the position where the movable block 13 moves along the screw 12, and send a position signal to the processing unit 15 when the movable block 13 move to a preset position, and then the processing unit 15 generates a stop instruction to stop actuator 11 rotating according to the position signal.

In FIG. 3, the position sensing device 14 is located near two side of the lower end of the movable block 13, and does not exceed the length of the screw 12, but the type and location of the position sensing device 14 is not limited thereto, it is to ensure that the moving range of the movable block 13 does not exceed the screw 12 and the movable block 13 is limited to different reciprocation range according to different preset position, so as to obtain different swing velocity, swing direction and swing angle of the hanger 131.

The processing unit 15 generates the start instruction according to the signal, swing angle, and swing direction signal, and the start instruction comprises a rotation instruction or a counter rotation instruction, the actuator 11 rotates according to the normal rotation instruction or rotates reversely according to the counter rotation instruction, to drive normal rotation or counter rotation of the screw 12, so that the movable block 13 reciprocate along the screw 12.

Figure 6:
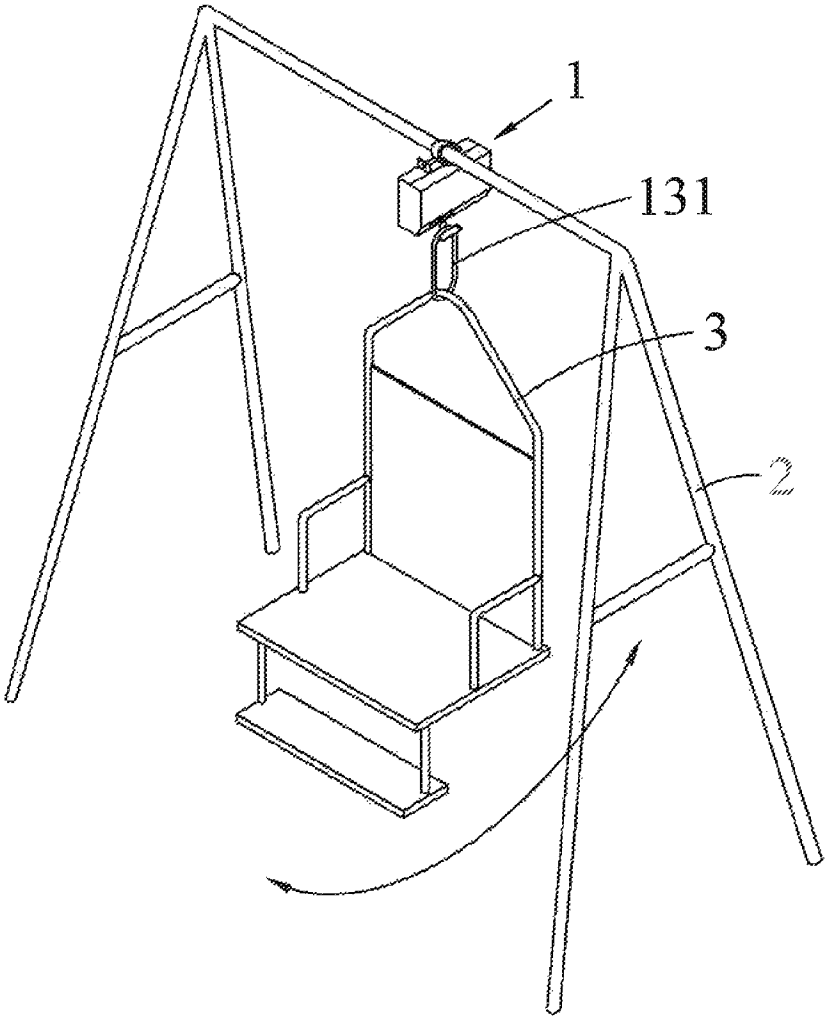
FIG. 6 is a schematic view of application of the second embodiment of the device for automatic swing control according to the present invention.
Figure 7:
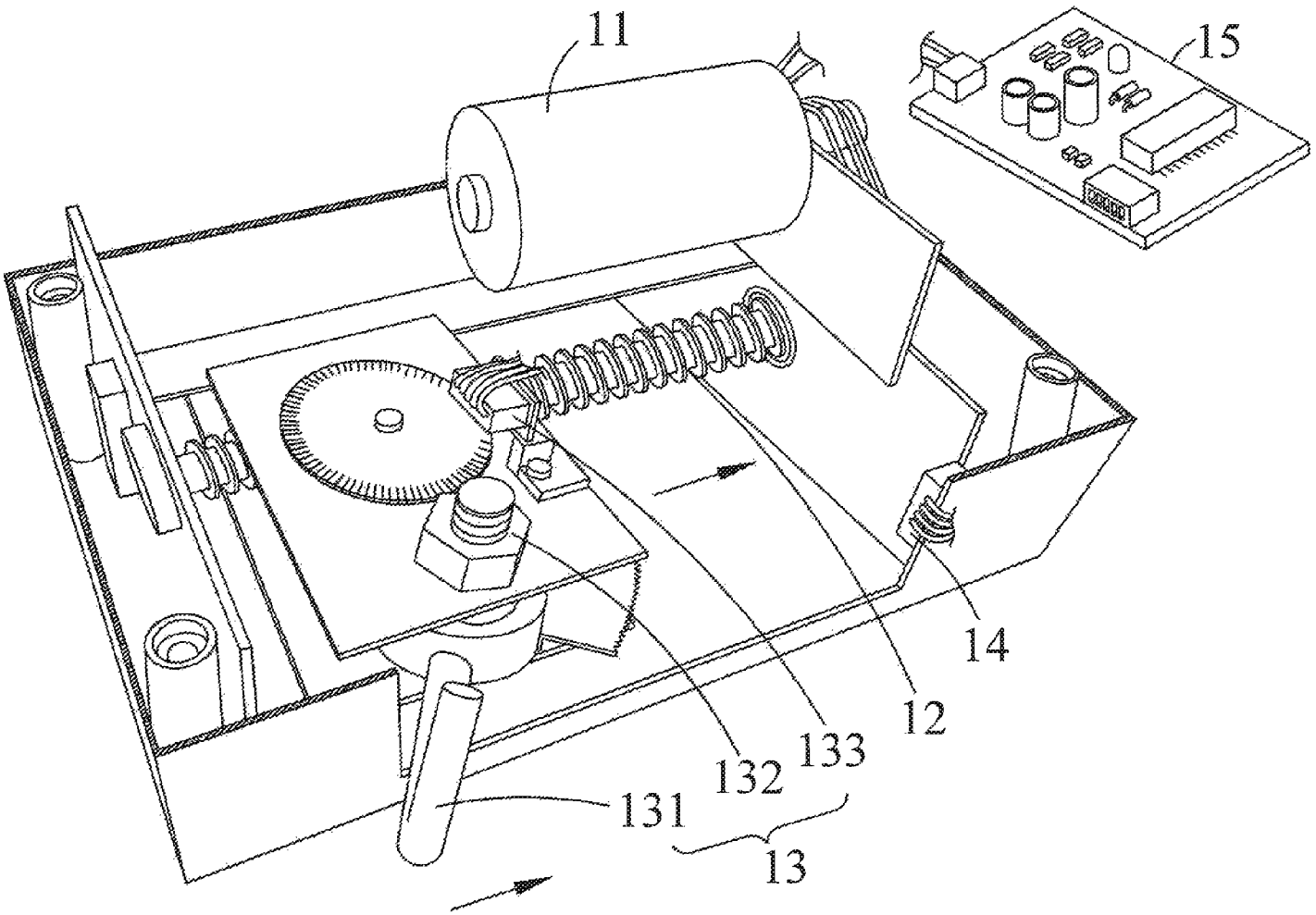
FIG. 7 is a schematic view of operation of the second embodiment according to the present invention.
Figure 8:
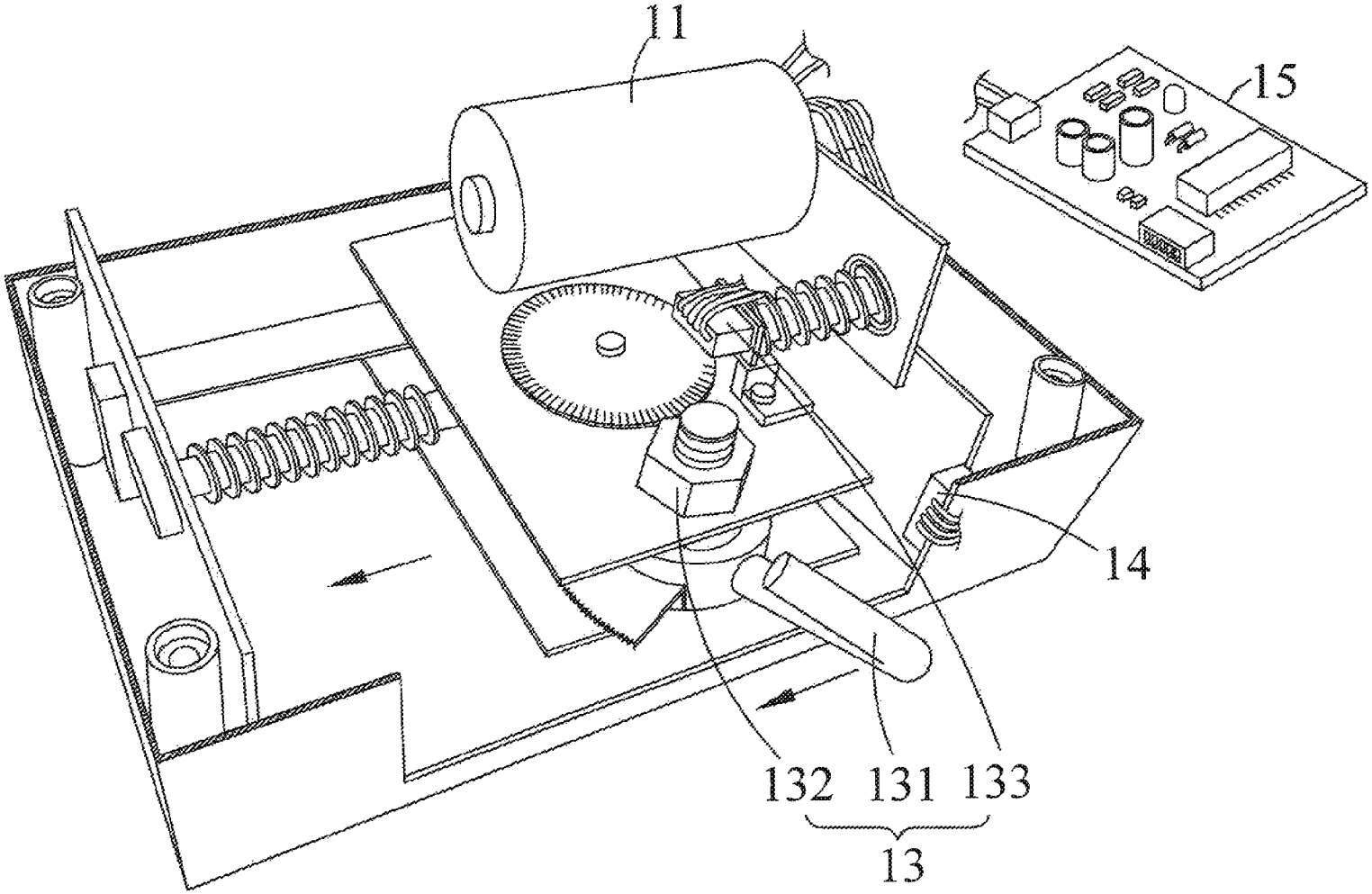
FIG. 8 is schematic view of operation of the second embodiment according to the present invention.

Please refer to FIG. 6 to FIG. 8 together, which illustrate schematic view of application of the second embodiment of the device for automatic swing control, first schematic view and second schematic view of operation of the second embodiment according to the present invention, respectively.

In FIG. 6, the device for automatic swing control 1 is fixed on top end of a suspending frame 2, and a free end of the hanger 131 is bent as a hook type, and the overhang 3 is hanged at the hook type free end of the hanger 131 to swing forward and backward. In this embodiment, the overhang 3 is expressed as a hanging chair, but it is not limited thereto, the overhang 3 also may be a swing, cradle or hammock, etc.

when the angle sensing device 133 senses that the swing angle of the hanger 131 is less than the preset value and the position sensing device 14 senses that the hanger 131 is at left side of the screw 12, the processing unit 15 sends a start instruction when the angle sensing device 133 senses the hanger 131 swinging to left predicted highest swing position, and then the actuator 11 drives rotation of the screw 12, so that the movable block 13 moves toward right side, and the hanger 131 is also about to swing toward right side, as shown in FIG. 7.

When the position sensing device 14 senses that the movable block 12 moves to right side preset position already, the processing unit 15 stops rotation of the actuator 11, so as to stop the screw 12 rotating. In the other hand, if the swing angle sensed by the angle sensing device 133 does not reach the preset value upon the comparison of the processing unit 15, the processing unit 15 drives the counter rotation of the screw 12 when the hanger 131 swings to right side predicted highest swing position, so that the movable block 13 moves toward left side, and the hanger 131 is also about to swing toward left side, as shown in FIG. 8.

Therefore, the movable block 13 reciprocates along the screw 12 several times, and direction of each movement of the movable block 13 is equal to the direction in which the hanger 131 is about to move after the hanger 131 passes its actual highest swing position, so as to drag the overhang to swing greater and increase the swing angle of the overhang 13 to the preset value.

Meanwhile, the angle sensing device 133 continuously senses the swing angle and swing direction of the hanger 131, if the swing angle reaches the preset value already, the processing unit 15 will stop the rotation of the actuator 11, so that the movable block 13 stop moving and only the overhang 3 continuously swings forward and backward due to inertial effect. When the angle sensing device 133 senses that the swing angle of the hanger 131 is lower than the preset value again, the processing unit 15 drives the normal rotation or counter rotation of the screw 12, so that the hanger 131 can swing to preset value again.

In this embodiment, it is not limited that normal rotation or counter rotation of the screw 12 drives the movable block 13 to move left or right, it depends on the mutual match between allocation of the actuator 11 and the screw thread direction of the screw 12, so that the movable block 13 can reciprocate along the screw 12.

By the configuration of the device for automatic swing control 1 according to the present invention, the hanger 131 can drive the overhang 3 to swing gently and smoothly without manpower push for swing of the overhang 3. Further, the greatest swing effect can be achieved by the smallest force, and the consumption of motor and electrical power can be reduced.

While this disclosure has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A device for automatic swing control, applied for automatic control of the swing of an overhang, the device for automatic swing control comprising:

an actuator, having selective normal rotation or counter rotation; and a movable block, located on a side of the actuator, and driven to reciprocate by the normal rotation or counter rotation of the actuator, the movable block comprising:

a hanger, pivotably mounted on a lower end of the movable block and used to suspend the overhang; and an angle sensing device; electrically connected to the actuator and used to sense a swing angle, a swing direction, and a predicted highest swing position of the hanger, and starting the selective normal rotation or counter rotation of the actuator when the swing angle is less than a preset value, so that when the hanger is at the predicted highest swing position, the movable block moves toward the direction in which the hanger is about to move after the hanger passes an actual highest swing position to drag the overhang to swing;

wherein, the predicted highest swing position is less than or equal to the actual highest swing position.

2. The device for automatic swing control of claim 1, wherein a pivot is located on one end of the hanger and corresponds to the angle sensing device, and the hanger swings around the pivot.

3. The device automatic swing control of claim 2, further comprising a processing unit electrically connected to the actuator and the angle sensing device, wherein the processing unit receives the swing angle, the swing direction, and the predicted highest swing position sensed by the angle sensing device, and compares the swing angle with the preset value, and the processing unit generates a start instruction to drive normal rotation or counter rotation of the actuator according to the swing direction and the predicted highest swing position when the swing angle is less than the preset value, so that when the hanger is at the predicted highest swing position, the movable block moves toward to the same direction in which the hanger is about to move after the hanger passes the actual highest swing position, to drag the overhang to swing.

4. The device for automatic swing control of claim 3, further comprising at least one position sensing device connected to the processing unit, wherein the position sensing device senses the position of the movable block and the processing unit generates a stop instruction to stop rotation of the actuator when the movable block moves to a preset position.

5. The device for automatic swing control of claim 4, further comprising a screw arranged horizontally, wherein the actuator is connected to an end of the screw, and the movable block is mounted on the screw, and a screw hole is located on the upper end of the movable block, the screw penetrates the screw hole and fits to the screw hole, so that the actuator drives the screw to rotate and the movable block reciprocates along the screw.

6. A method for automatic swing control, applied to use a device for automatic swing control for automatic control of the swing of an overhang, the device for automatic swing control comprising an actuator and a movable block, the movable block comprising a hanger and an angle sensing device, the method for automatic swing control comprising following steps of:

using the angle sensing device to sense a swing angle, a swing direction, and a predicted highest swing position of the hanger;

starting the selective normal rotation or counter rotation of the actuator when the swing angle is less than a preset value; and according to the normal rotation or counter rotation of the actuator, when the hanger is at the predicted highest swing position, moving the movable block toward to the same direction in which the hanger is about to move after the hanger passes the actual highest swing position, to drag the overhang to swing;

wherein the predicted highest swing position is less than or equal to the actual highest swing position.

7. The method for automatic swing control of claim 6, wherein the device for automatic swing control further comprises a processing unit, and a pivot is located on one end of the hanger, and the method for automatic swing control further comprises the following steps of:

swinging the hanger around the pivot;

using the processing unit to compare the swing angle with the preset value sensed by the angle sensing device;

using the processing unit to generate a start instruction to drive rotation of the actuator when the swing angle is less than the preset value; and according to the rotation of the actuator, when the hanger is at the predicted highest swing position, moving the movable block toward to the same direction in which the hanger is about to move after the hanger passes the actual highest swing position.

8. The method for automatic swing control of claim 7, wherein the device for automatic swing control further comprises a position sensing device, and the method for automatic swing control further comprises the following steps of;

using the position sensing device to sense the position of the movable block; and using the processing unit to generate a stop instruction to stop the rotation of the actuator when the movable block moves to a preset position.

9. The method for automatic swing control of claim 8, wherein the start instruction comprises a normal rotation instruction or a counter rotation instruction, the actuator rotates clockwise according to the normal rotation instruction or rotates counterclockwise according to the counter rotation instruction, to drive the movable block to reciprocate.

10. The method for automatic swing control of claim 9, wherein the device for automatic swing control further comprises a screw, the actuator rotates clockwise according to the normal rotation instruction or rotates counterclockwise according to the counter rotation instruction, to drive the clockwise or counterclockwise rotation of the screw, so that the movable block reciprocates along the screw.

* * * * *